US009290248B1

(12) United States Patent
Chung

(10) Patent No.: US 9,290,248 B1
(45) Date of Patent: Mar. 22, 2016

(54) UNDERWATER CRANE

(71) Applicant: Pei Wen Chung, Taipei (TW)

(72) Inventor: Pei Wen Chung, Taipei (TW)

( * ) Notice: Subject to any disclaimer, the term of this patent is extended or adjusted under 35 U.S.C. 154(b) by 0 days.

(21) Appl. No.: 14/582,573

(22) Filed: Dec. 24, 2014

(51) Int. Cl.
*B63C 7/10* (2006.01)
*B63C 7/08* (2006.01)

(52) U.S. Cl.
CPC ..... *B63C 7/08* (2013.01)

(58) Field of Classification Search
CPC ..... B63C 7/06; B63C 7/12; B63C 7/10
USPC ..... 114/44, 50, 51, 54
See application file for complete search history.

(56) References Cited

U.S. PATENT DOCUMENTS 284,667 A * 9/1883 Powers ..... B63C 7/12 114/54
2,413,313 A * 12/1946 Cook ..... B63C 7/12 114/54
2,635,574 A * 4/1953 Sturtevant ..... B63C 7/10 114/54
2,887,080 A * 5/1959 Fedrowich ..... B63C 7/06 114/54
3,500,785 A * 3/1970 Strange ..... B63C 7/06 114/50
3,608,510 A * 9/1971 De Vries ..... B63C 7/10 114/54
3,860,983 A * 1/1975 Furth ..... B63B 22/02 114/333
4,078,509 A * 3/1978 Buecher ..... B63C 7/10 114/54
4,448,569 A * 5/1984 Hackman ..... B63C 7/24 114/55
4,498,408 A * 2/1985 Otteblad ..... B63C 7/10 114/52
4,510,878 A * 4/1985 Breedlove ..... B63C 11/02 114/315
4,658,745 A * 4/1987 Buecher ..... B63C 7/10 114/50
5,031,555 A * 7/1991 Allen ..... B63B 22/22 114/50
5,516,235 A * 5/1996 Stangroom ..... B63C 7/10 114/50
5,797,340 A * 8/1998 Peeters ..... B63B 21/22 114/221 R
6,347,970 B1 * 2/2002 Weinel ..... B63C 7/10 114/68
6,575,403 B1 * 6/2003 Monroe ..... B64B 1/70 244/31
8,424,847 B2 * 4/2013 Scott ..... B63C 7/20 254/389
8,622,137 B2 * 1/2014 Childres ..... E21B 19/002 166/338

* cited by examiner

*Primary Examiner* — S. Joseph Morano
*Assistant Examiner* — Jovon Hayes
(74) *Attorney, Agent, or Firm* — Chun-Ming Shih

(57) ABSTRACT

An underwater crane is provided with a float ball including arc member on a bottom, and a ring attached to the arc member; and a plurality of weights each including a rope having a hook member at an open end, the hook member being secured to the arc member. In a salvaging operation, a diver may temporarily secure the ring to a structure sunk to, for example the sea floor, the diver may disengage the hook members from the arc member, and finally, the weights are rested on the sea floor and the float ball and the structure together move upward until the float ball reaches the surface of the sea due to buoyancy of the float ball.

4 Claims, 3 Drawing Sheets

UNDERWATER CRANE

BACKGROUND OF THE INVENTION

1. Field of the Invention

The invention relates to underwater cranes and more particularly to a simple underwater crane for salvaging heavy things sunk to a sea (or river) floor.

2. Description of Related Art

Sea salvage is defined as lifting a structure sunk to a sea (or river) floor and transporting it to the shore by using a crane. It is understood that sea salvage is more difficult than lifting and lowering materials and moving them horizontally on the land. This is because water in the sea (or river) is not static. Typically, the crane for salvage is installed on a large ship. However, the installation is labor intensive and cost ineffective.

Thus, the need for improvement still exists.

SUMMARY OF THE INVENTION

It is therefore one object of the invention to provide an underwater crane comprising a float ball including arc member on a bottom, and a ring attached to the arc member; and a plurality of weights each including a rope having a hook member at an open end, the hook member being secured to the arc member wherein in a salvaging operation, a diver may temporarily secure the ring to a structure sunk to, for example the sea floor, the diver may disengage the hook members from the arc member, and finally, the weights are rested on the sea floor and the float ball and the structure together move upward until the float ball reaches the surface of the sea due to buoyancy of the float ball.

Preferably, buoyancy of the float ball is equal to or less than a sum of the weights.

Preferably, the float ball is submerged by securing the hook members of the weights to the arc member of the float ball.

Preferably, in response to disengaging the hook members from the arc member, the float ball moves upward until the float ball reaches a surface of a water body.

BRIEF DESCRIPTION OF THE DRAWINGS

The invention, as well as its many advantages, may be further understood by the following detailed description and drawings in which.

DETAILED DESCRIPTION OF THE INVENTION

Figure 1:
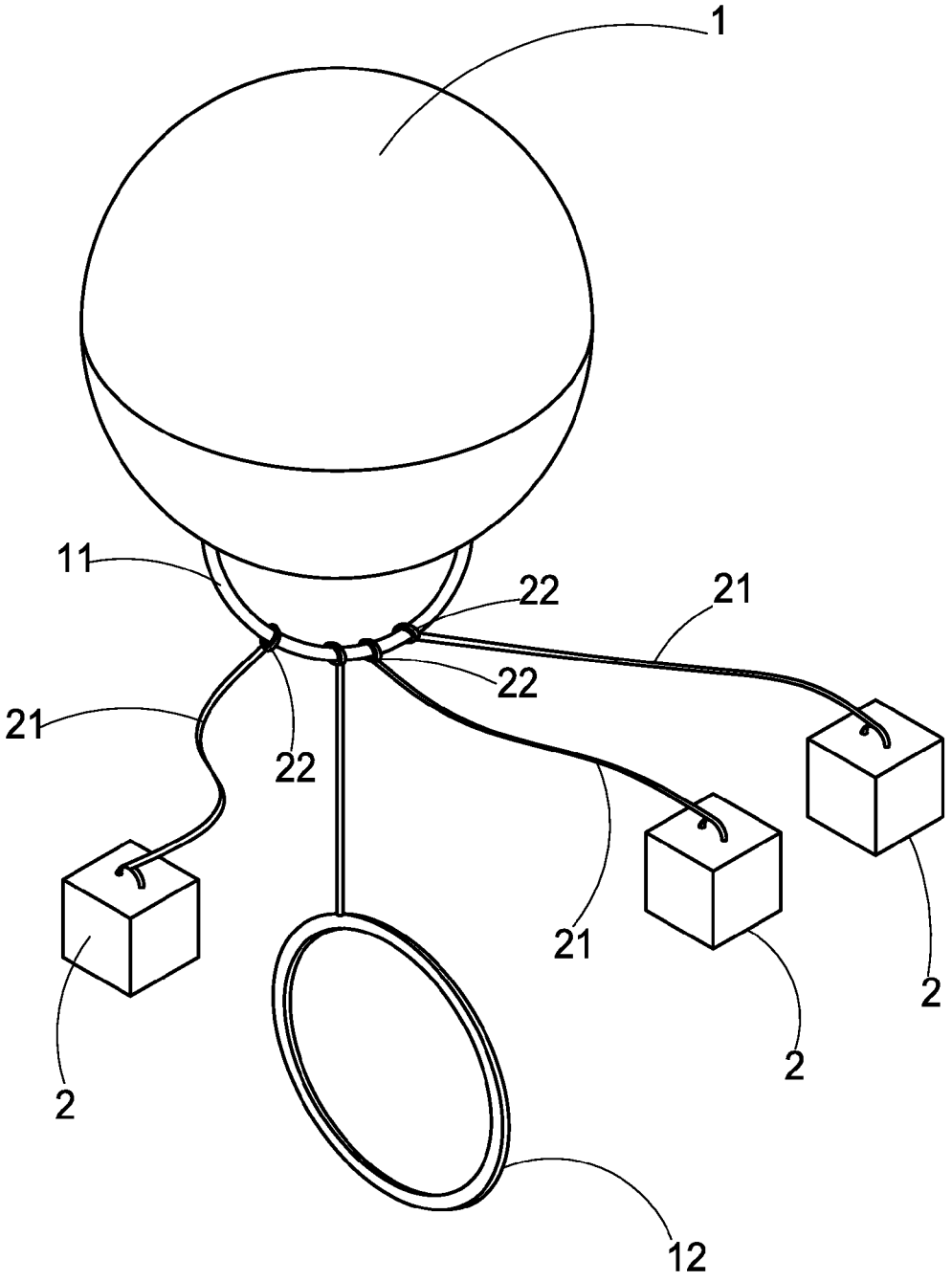
FIG. 1 is a view of an underwater crane according to the invention.
Figure 2:
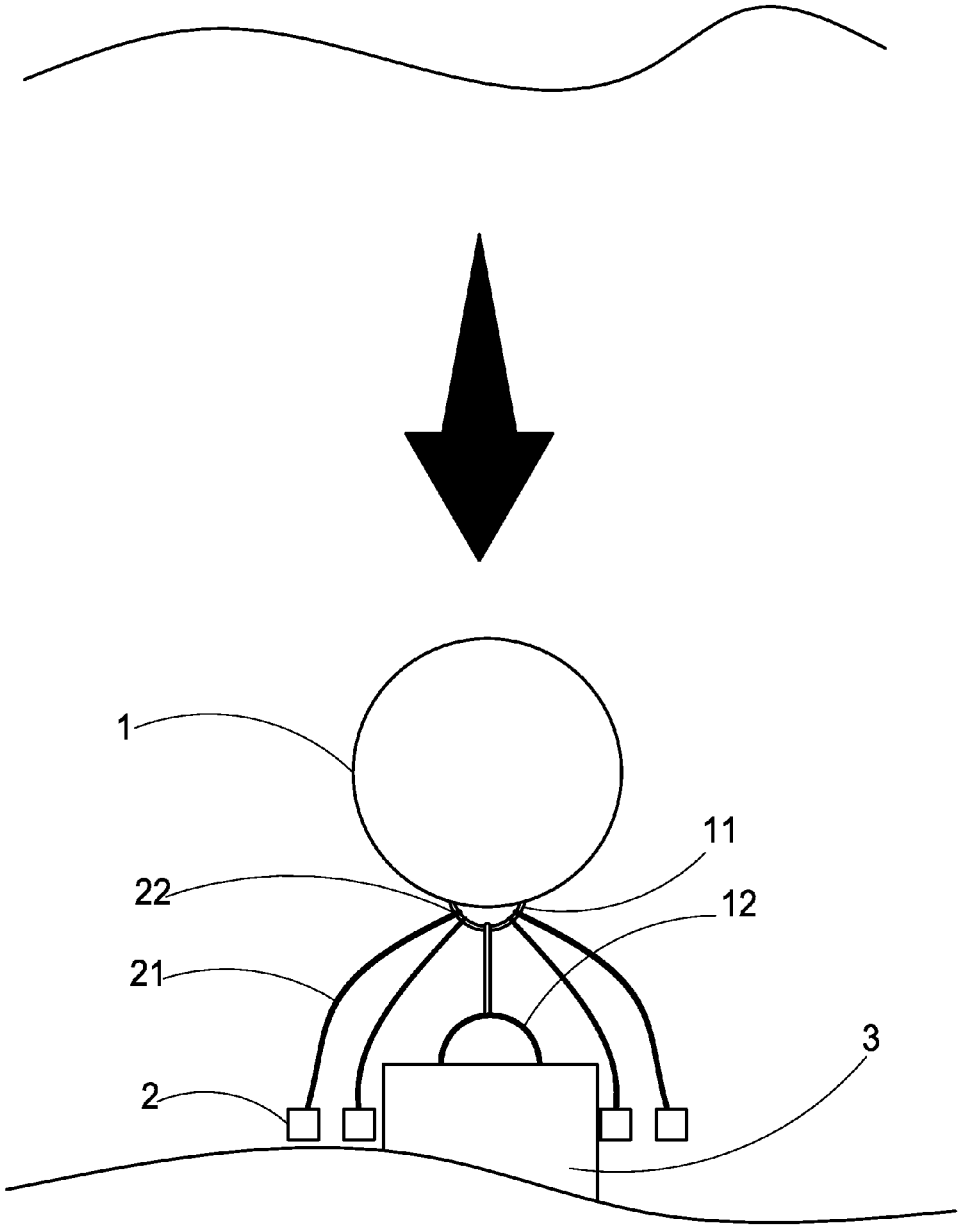
FIG. 2 schematically depicts the xx being temporarily secured to a structure sunk to sea floor.
Figure 3:
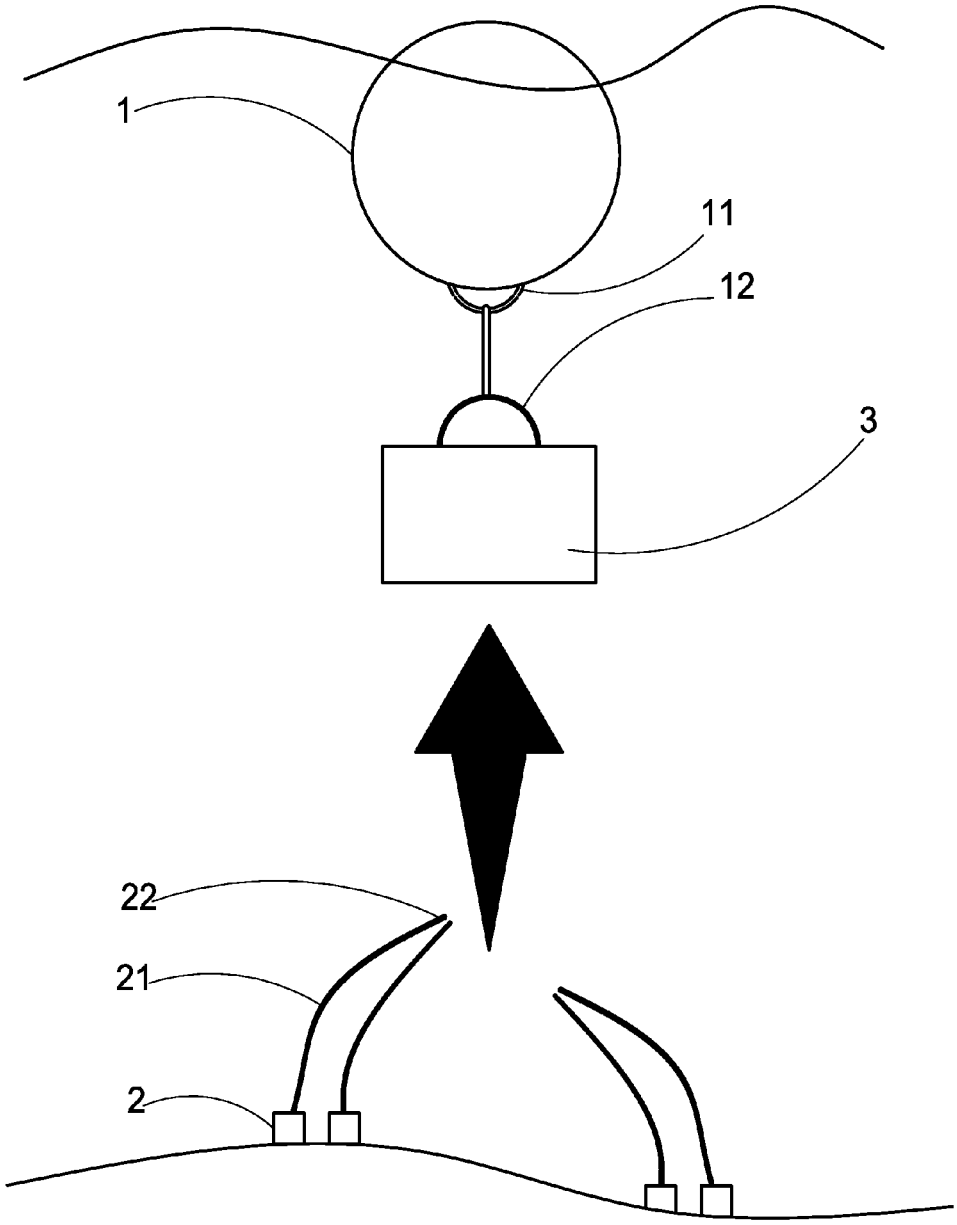
FIG. 3 is similar to FIG. 2 showing the structure being lifted to submerge in the water.

Referring to FIGS. 1 to 3, an underwater crane in accordance with the invention comprises as discussed in detail below.

A float ball 1 includes an arc member 11 on a bottom and a ring 12 attached to the arc member 11. A plurality of weights 2 each include a rope 21 having a first end secured to the weight 2 and a hook member 22 at a second end secured to the arc member 11.

Preferably, buoyancy of the float ball 1 is equal to or less than a sum of the weights 2.

Preferably, the float ball 1 is submerged by securing the hook members 22 of the weights 2 to the arc member 11 of the float ball 1.

In a salvaging operation, a diver may temporarily secure the ring 12 to a structure 3 sunk to, for example the sea floor. Thereafter, the diver may disengage the hook members 22 from the arc member 11. Finally, the weights 2 are rested on the sea floor and the float ball 1 and the structure 3 together move upward until the float ball 1 reaches the surface of the sea due to buoyancy of the float ball 1 (i.e., the float ball 1 being submerged).

It is envisaged by the invention that the underwater crane can easily lift a structure rested on, for example the sea floor and move it to a destination.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An underwater crane comprising:

a float ball including an arc member directly installed on a bottom thereof, and a ring attached to the arc member, wherein a structure sunk to a sea or river floor is directly secured to the ring; and a plurality of weights each including a rope having a hook member at an open end, the hook member being directly secured to the arc member so that the plurality of weights are attached to the arc member.

2. The underwater crane of claim 1, wherein buoyancy of the float ball is equal to or less than a sum of the weights.

3. The underwater crane of claim 2, wherein the float ball is submerged by securing the hook members of the weights to the arc member of the float ball.

4. The underwater crane of claim 3, wherein in response to disengaging the hook members from the arc member, the float ball moves upward until the float ball reaches a surface of a water body to lift the structure from the sea or river floor.

* * * * *